US008484855B1

(12) United States Patent
King, Sr.

(10) Patent No.: US 8,484,855 B1
(45) Date of Patent: Jul. 16, 2013

(54) FLEXIBLE PLASTIC UTENSIL

(76) Inventor: Larry Don King, Sr., Orlando, FL (US)

( * ) Notice: Subject to any disclaimer, the term of this patent is extended or adjusted under 35 U.S.C. 154(b) by 0 days.

(21) Appl. No.: 13/495,071

(22) Filed: Jun. 13, 2012

(51) Int. Cl.
*A47J 43/28* (2006.01)
*B65D 41/56* (2006.01)

(52) U.S. Cl.
USPC ..... 30/324; 30/328; 220/212

(58) Field of Classification Search
USPC ..... 30/147, 149, 324–328, 345; 220/212
See application file for complete search history.

(56) References Cited

U.S. PATENT DOCUMENTS 4,393,988 A * 7/1983 Burke ..... 229/125.03
2008/0110885 A1* 5/2008 Cross ..... 220/212.5

* cited by examiner

*Primary Examiner* — Kenneth E. Peterson
*Assistant Examiner* — Samuel A Davies

(57) ABSTRACT

A convenient and functional spoon-like utensil, easily transformed from the integrated composite of a thin piece of plastic adhered to a typical foil-type lid material used currently in the food industry. When the composite is rolled or folded, it forms a strong, ridged utensil with which to consume the food contents while "on-the-go."

1 Claim, 2 Drawing Sheets

FLEXIBLE PLASTIC UTENSIL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Figure 1:
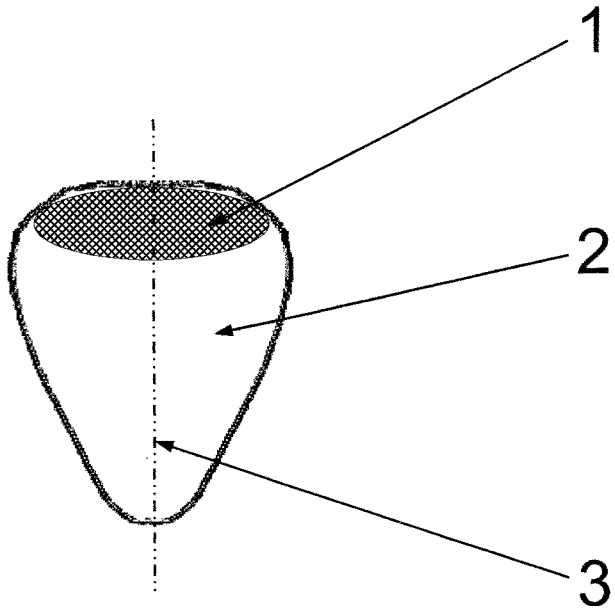

1) Field of the Invention:

The invention relates to the means and methods for the development of a transformable food container lid, or its contents' containment membrane material, into a convenient and functional spoon-like utensil for the consumption of the contained food product.

2) Description of Related Art:

There have been numerous patent attempts, known by the related art, to create a suitable utensil to be packaged with food products. These attempts however, have failed to provide the superior advantages of this invention.

U.S. Pat. No. 3,722,779 Chang discloses a spoon attached diagonally on the bottom side of a rectangular container lid, which renders it totally unacceptable for use in the mass produced single-serve food product market.

U.S. Pat. No. 3,931,925 Ruff discloses a flat paper lid, convertible through numerous complex manipulations, into a crude paddle-like utensil not suitable for use in the mass produced single-serve food product market.

U.S. Pat. No. 4,060,176 Tobiasson discloses "A food container lid . . . which is convertible into a spoon" utilizing the lid material as the spoon, after peeling a section from within the lid proper, and not suitable for use in the mass produced single-serve food product market.

U.S. Pat. No. 4,218,010 Ruff discloses a "container lid convertible into a spoon" which would not be satisfactory for use in the mass produced single-serve food product market.

U.S. Pat. No. 4,393,988 Burke discloses a container lid that includes a spoon-like tab, very similar to the "tongue-like" projection of the U.S. Pat. No. 8,210,010 Cross spoon. However, neither provide a spoon-like utensil suitable for use in the mass produced single-serve food product market.

U.S. Pat. No. 8,210,381 Cross discloses a self-contained, monolithic utensil which can be used either independently or attached to the top of a containers' containment membrane, and therefore, actually becomes the containers' second lid. It would be practically impossible to incorporate the Cross utensil beneath the containers' containment membrane, and would likely increase the product packaging cost beyond economic feasibility.

Of all the patents cited, three have relative interest, U.S. Pat. No. 4,060,176 Tobiasson, U.S. Pat. No. 4,393,988 Burke, and U.S. Pat. No. 8,210,381 Cross, in that they all teach the incorporation of a spoon-like utensil into, or onto, the lids of food containers. However, all of these solutions fall short of providing the superior advantages of this invention for use in the mass produced single-serve food product market.

BRIEF SUMMARY OF THE INVENTION

The invention excels above all other attempts of related art by providing a viable and economically feasible spoon-like utensil, easily converted from the integrated composite of a thin, triangular shaped piece of plastic adhered to the food side of a foil-type containment membrane used in food packaging.

BRIEF DESCRIPTION OF THE DRAWING(S)

FIG. 1: Is the top plan view of the bowl portion of the invention showing the thin, triangular shaped piece of flexible plastic and identifying the location of the adhesive and imaginary fold line.

Figure 2:
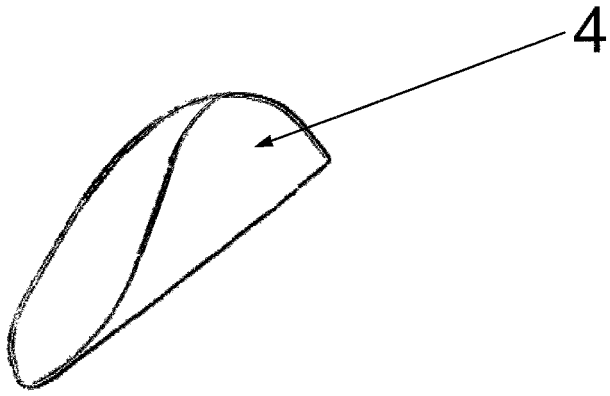

FIG. 2: Is the top isometric view of the bowl portion of the invention showing the thin, triangular shaped piece of flexible plastic after it has been transformed into the bowl of the spoon-like utensil.

Figure 3:
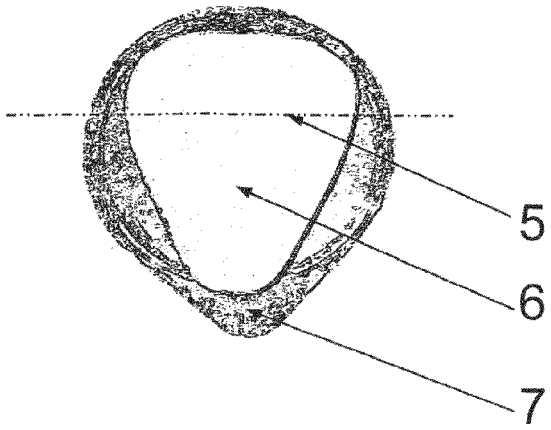

FIG. 3: Is the top plan view of the invention showing the thin, triangular shaped piece of flexible plastic after being adhered to a typical foil-type lid or containment membrane currently in use by the food industry to close their containers.

Figure 4:
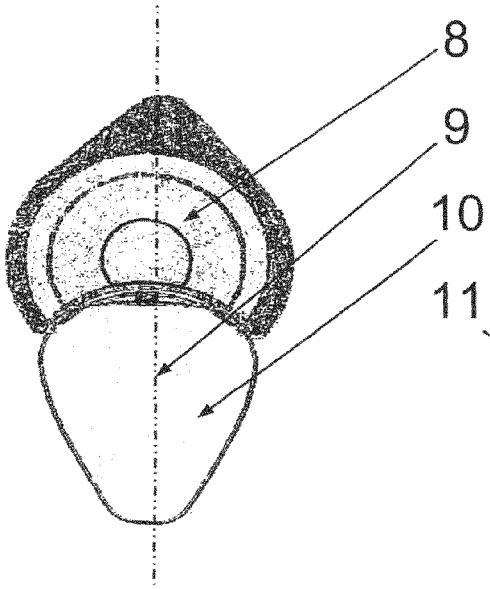

FIG. 4: Is the top plan view of the invention after the foil-type lid or containment membrane has been folded back onto itself along the imaginary fold line of FIG. 3 and shows the new imaginary fold line along which the integrated composite will next be folded. Once the two sides of the thin, triangular shaped piece of flexible plastic are touching, the foil alone is folded again onto itself twice resulting in FIG. 5.

Figure 5:
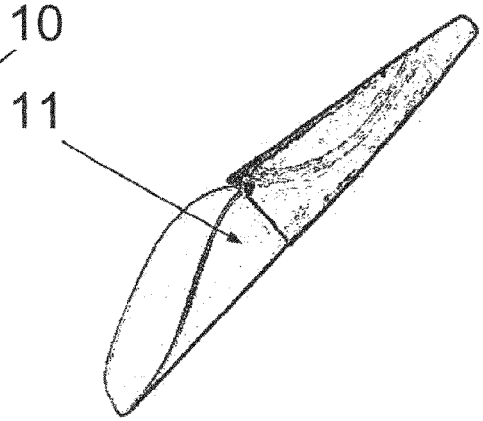

FIG. 5: Is the top isometric view of the invention ready for use as a spoon-like utensil for consuming food product from its container.

INDEX TO DRAWING(S)

Adhesive to attach the thin plastic to the foil membrane

Thin, triangular shaped piece of plastic, with rounded corners, forming the spoon's bowl Imaginary fold line defining the direction of the fold to create the spoon's bowl Finished bowl of the invention in isometric projection Imaginary fold line defining the direction to fold the foil membrane back on itself Thin, triangular shaped piece of plastic adhered to the foil membrane, 7.

Foil membrane used by food industry to close their containers

Foil membrane after the initial fold back onto itself

Imaginary fold line defining the direction to fold the integrated composite

Thin, triangular shaped piece of plastic forming bowl of composite spoon-like utensil Finished invention ready for use as a spoon-like utensil for consuming food product

DETAILED DESCRIPTION OF THE INVENTION

The invention consists of integrating two commonly known materials, plastic and foil, into a composite, spoon-like utensil that will provide the food manufacturer with a viable and economically feasible enhancement to their product as well as the consumer with a convenient and functional way to consume packaged food products while "on-the-go."

The bowl portion of the utensil is constructed of a strong, thin, flexible piece of FDA compliant plastic 2, die-cut, cut, or otherwise formed into a planar piece, of triangular shape, with each of its three corners rounded, as illustrated in the drawings. The maximum size of the plastic piece is controlled by the size of the food container lid or foil membrane, in that the extent of its exterior boundary shall not exceed a size that would allow it to be fully enclosed within the inside boundary of the container's membrane so as not to interfere with the process or effectiveness of attaching the foil membrane to the food container.

FDA compliant adhesive 1, is utilized to attach the plastic 2, to the food side, or bottom, of the foil-type membrane 7, by applying the appropriate quantity of adhesive 1, to either the plastic 2, or to the foil membrane 7, whichever best suits the manufacturers' packaging process.

The integrated composite, FIG. 3, is ready for the packaging containment process, sealing the attached plastic 2, 6, bowl within the sterile confines of the packaged food product.

When the invention is incorporated into a food container that is purchased by a consumer interested in consuming the food "on-the-go," the consumer simply peels the foil membrane 7, from the food container, wipes any food-stuff from the bottom of the foil 7, and plastic 6, and folds the foil 7, back onto itself along fold line 5, as shown in FIG. 4.

The integrated composite, FIG. 4, is then folded along fold line 9, until the exterior wings of the plastic 10, touch each other. The foil 8, now with both side touching. is folded twice onto itself, forming the complete invention 11, ready for use as a spoon-like utensil for consuming food product.

The invention claimed is:

1. A transformable containment membrane comprising:

a foil lid for sealing a prepackaged food container;

a flexible, triangular piece with rounded corners having a first end and a second free end opposite the first end;

wherein the triangular piece is made of plastic and is attached at the first end with adhesive to the lid along a peripheral edge of a food side of the lid so as to be in an unexposed position when the lid is sealed to the food container;

wherein folding the second end of the triangular piece away from the lid and along the adhesive places the free end of the triangular piece into an exposed position past the peripheral edge of the lid, and folding both the lid and the triangular piece along a common axis converts the containment membrane into a composite spoon.

* * * * *